US005738397A

United States Patent [19]

Grody et al.

[11] Patent Number: 5,738,397

[45] Date of Patent: Apr. 14, 1998

[54] SHELL DOOR LOCKING DEVICE

[76] Inventors: Steven Grody, 427 Coyton St., #250, Los Angeles, Calif. 90013; Jeffrey Atherton, 5396 Alhambra Ave., Los Angeles, Calif. 90032

[21] Appl. No.: 555,881

[22] Filed: Nov. 14, 1995

[51] Int. Cl.[6] ..... B65D 45/00

[52] U.S. Cl. ..... 292/258; 292/DIG. 43

[58] Field of Search ..... 292/288, 289, 292/294, 305, 339, 338, 258, DIG. 43

[56] References Cited

U.S. PATENT DOCUMENTS

| | | | |
|---|---|---|---|
| 4,819,461 | 4/1989 | Pearson | 292/DIG. 43 X |
| 5,150,934 | 9/1992 | Grody | 292/288 |
| 5,154,459 | 10/1992 | Cochran | 292/258 |
| 5,165,743 | 11/1992 | Zock | 292/288 |
| 5,174,456 | 12/1992 | Grody | 292/258 X |

*Primary Examiner*—Rodney M. Lindsey
*Attorney, Agent, or Firm*—Merchant, Gould, Smith, Edell, Welter & Schmidt

[57] ABSTRACT

A device for locking the door or flap of a typical pick-up truck shell closed from the interior of the shell includes a substantially rigid body which is selectively secured to moving parts of a latch mechanism. The device is designed to operate with an existing shell door or flap latching mechanism of the type having a rotatable shaft coupled to a pivotable plate. According to such existing latching mechanisms, the pivotable plate is pivoted (or rotated) between first and second positions. In the first position, the plate partially overlaps a portion of the rear wall of the shell (or the truck bed or tailgate) to inhibit the shell door or flap from swinging open. In the second position, the plate does not overlap a portion of the shell (truck bed or tailgate), so as to allow the shell door or flap to swing open. In order to lock the shell door or flap, the substantially rigid body is secured to the pivotal plate of the latch mechanism from the interior of the shell. The rigid body has a body portion which overlaps a portion of the shell when the pivotal plate of the latch mechanism is in the second position. As a result, the shell door or flap is inhibited from swinging open, even when the pivotal plate is in the second position.

5 Claims, 4 Drawing Sheets

FIG. 8
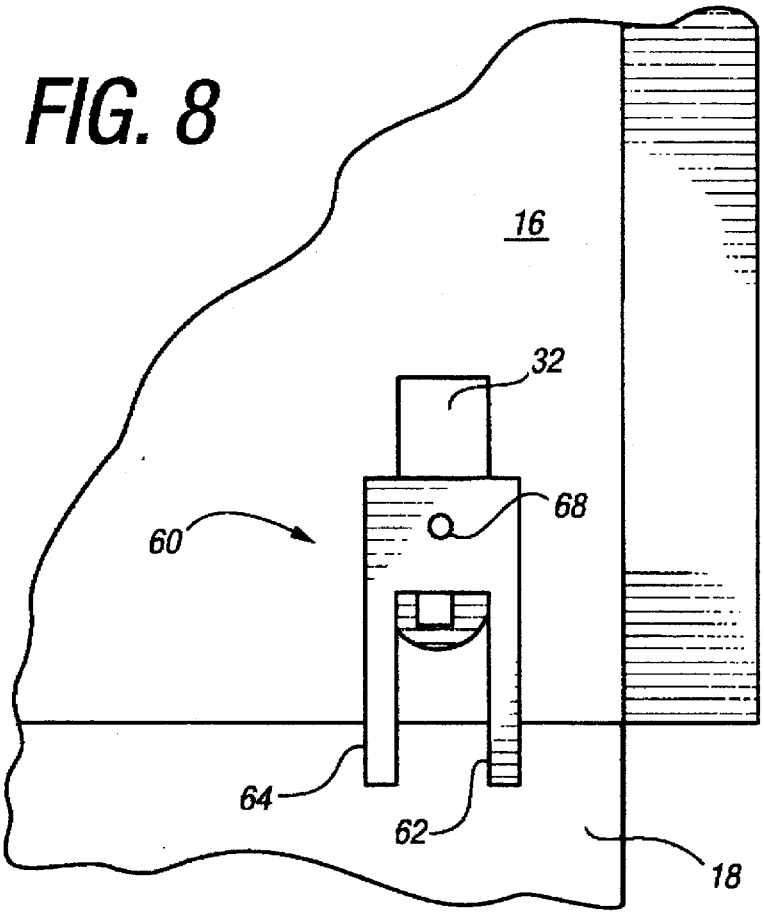
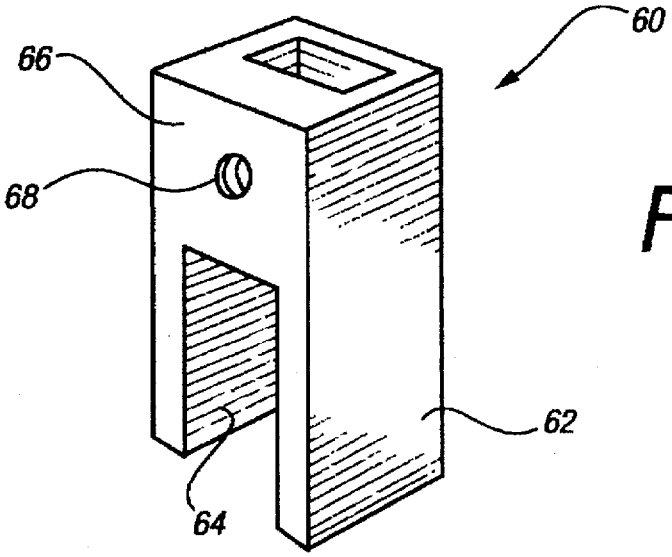
FIG. 9

SHELL DOOR LOCKING DEVICE

BACKGROUND OF THE INVENTION

1. Field of the Invention

The present invention relates to a shell locking device and, more specifically to a device for locking the door of a pick-up truck bed shell disposed, e.g., over the bed of a pick-up truck, from the interior of the shell.

2. Related Art

Various types of pick-up truck bed shell devices which fit over the bed of a pick-up truck have been known for quite some time. Such shell devices are typically attached to the side walls of the bed of a pick-up truck by bolts, brackets or other well known mechanisms.

Such shell devices typically include a hinged door or flap which may be opened and closed to selectively provide access or restrict access to the interior of the camper shell and pick-up truck bed. Such shell devices also typically include a latch mechanism which allows a user to latch the door or flap closed from the outside of the shell and pick-up truck bed. Many of these latch devices include a locking mechanism, such as a key lock, which allows a user to lock the door or flap closed from the outside of the shell or pick-up truck bed.

Many pick-up truck shell owners use the pick-up truck bed and shell to hold people, e.g. for transportation, sleeping, camping, etc. However, the pick-up truck shell devices known to the inventor do not allow a person inside of the shell and pick-up truck bed to lock the door or flap of the shell closed from the interior of the shell or bed. Recognizing the deficiencies of such known shell devices and latching mechanisms, the inventor has designed a unique device which allows a person inside of the shell or pick-up truck bed to readily lock and unlock the door or flap of a typical shell, e.g., for security or safety reasons.

SUMMARY OF THE INVENTION

The present invention relates to methods and devices for locking the door or flap of a typical pick-up truck shell closed from the interior of the shell. Embodiments of the invention employ a substantially rigid body which is selectively secured to moving parts of the existing latch mechanism to, in effect, nullify the motion of such moving parts, to, thereby, selectively prohibit the door or flap of the shell from being unlocked.

A preferred embodiment of the invention is designed to operate with an existing shell door or flap latching mechanism of the type having a rotatable shaft coupled to a pivotable plate. According to such existing latching mechanisms, the pivotable plate is pivoted (or rotated) between first and second positions. In the first position, the plate partially overlaps a portion of the rear wall of the shell (or the truck bed or tailgate) to inhibit the shell door or flap from swinging open. In the second position, the plate does not overlap a portion of the shell (truck bed or tailgate), so as to allow the shell door or flap to swing open.

In order to lock the shell door or flap, the substantially rigid body is secured to the pivotal plate of the latch mechanism from the interior of the shell. The rigid body has a body portion which overlaps a portion of the shell (or truck bed or tailgate) when the pivotal plate of the latch mechanism is in the second position (i.e., the position in which the pivotal plate does not overlap the shell, truck bed or tailgate). As a result, the shell door or flap is inhibited from swinging open, even when the pivotal plate is in the second position.

Preferably, when secured to the pivotal plate, the rigid body includes a body portion which overlaps a portion of the shell (or truck bed or tailgate) at all instances during the movement of the pivotal plate between the first and second positions. Accordingly, either the pivotal plate or the rigid body secured to the pivotal plate is in an overlapping position (overlapping a portion of the shell, truck bed or tailgate) at all times before, during and after the movement of the pivotal plate from the first position to the second position. This, in effect, nullifies the movement of the pivotal plate between the first and second positions.

The rigid body includes securing means for allowing a person inside of the truck bed and shell to readily secure the body to the pivotal plate and readily remove the body from the plate. In preferred embodiments, the securing means comprises a slot formed in a portion of the body, for receiving the pivotal plate. In further preferred embodiments, a set screw is provided for further securement of the rigid body to the pivotal plate. From inside of the truck bed and shell, a person may place the shell door or flap in a closed position and secure the rigid body to the pivotal plate. If the shell door or flap is provided with two latch mechanisms, two rigid bodies may be placed on the two pivotal plates of the two respective latch mechanisms.

In this manner, a person inside of the shell and pick-up bed may lock the flap or door in a closed position and inhibit the flap or door from being opened by, in effect, nullifying any movement of the pivotal plates of the latch mechanisms. By simply removing the rigid body (or bodies) form the pivotal plate (or plates), the person inside of the truck bed and shell may easily unlock the latch mechanism(s) to thereby allow the shell door or flap to be unlatched and swung open. Thus, preferred embodiments of the present invention employ a rigid body that operates as a keyless lock which makes it virtually impossible for one inside of the shell to lock the flap or door without the ability to unlock the flap or door from inside the shell.

BRIEF DESCRIPTION OF THE DRAWINGS

The detailed description of embodiments of the invention will be made with reference to the accompanying drawings, wherein like numerals designate corresponding parts in the several figures.

FIG. 8 shows a shell door latch mechanism in the unlatched position with a further embodiment of a locking device secured thereto.

FIG. 9 shows the locking device in FIG. 8.

DESCRIPTION OF THE PREFERRED EMBODIMENTS

The following detailed description is of the best presently contemplated mode of carrying out the invention. This description is not to be taken in a limiting sense, but is made merely for the purpose of illustrating the general principles of the invention. The scope of the invention is best defined by the appended claims.

Figure 1:
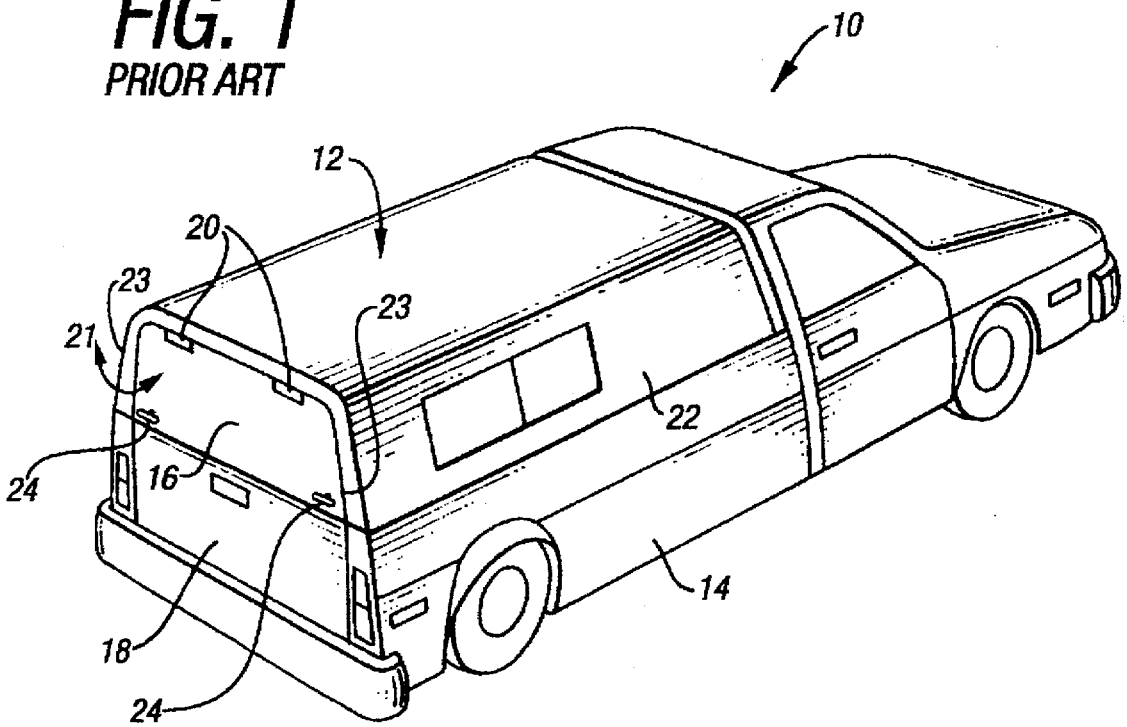
FIG. 1 PRIOR ART
FIG. 1 is a perspective view of a conventional pick-up truck and a conventional pick-up truck shell arranged over the bed of the pick-up truck.

The present invention relates to methods and devices for locking the door or flap of a typical pick-up truck shell closed from the interior of the shell. FIG. 1 shows a conventional pick-up truck 10 with a conventional pick-up truck shell 12 arranged over the bed 14 of the truck. The illustrated shell 12 has a door or flap 16 disposed over the tailgate 18 of truck 10. Door 16 is hinged at hinges 20 to the main body 22 of shell 12. The hinges 20 allow the door to be swung between a closed position as shown in FIG. 1 towards an open position, in the direction of arrow 21.

Handles 24 each rotate to operate a latch mechanism for selectively latching the door 16 in a closed position to the main body 22 of shell 12. For example, two handles 24 shown in FIG. 2 operate two respective latch mechanisms 28 discussed below. The handles are configured to be gripped and rotated by a person outside of the shell 12 to operate the latch mechanisms.

Figure 2:
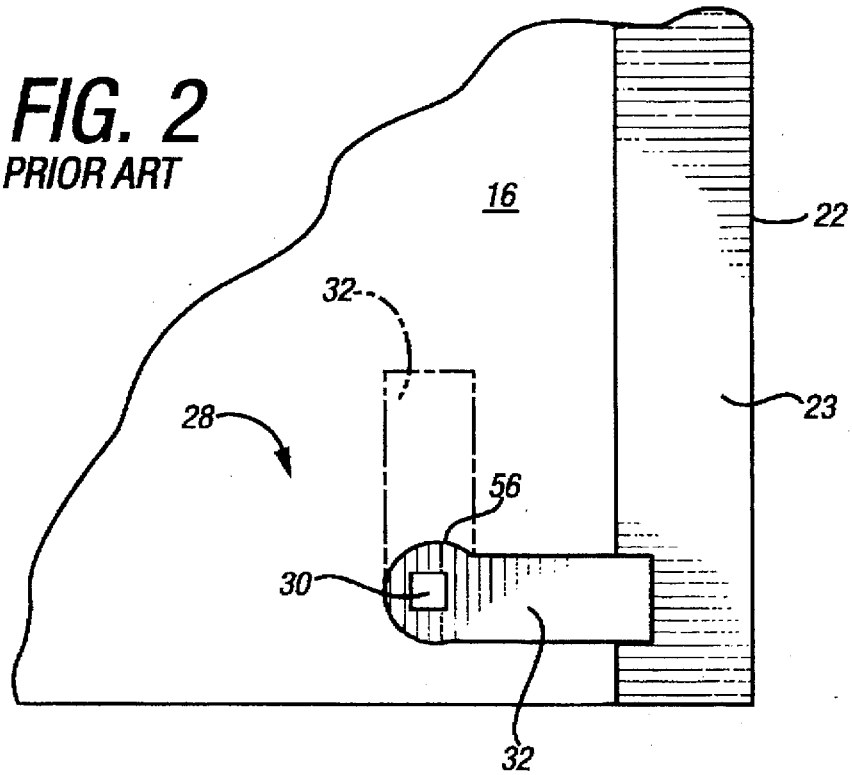
FIG. 2 PRIOR ART
FIG. 2 shows a conventional shell door latch mechanism in the latched position in solid lines and in an unlatched position in broken lines, as viewed from the inside of the shell.

A typical latch mechanism, such as shown at 28 in FIG. 2, includes a rotatable shaft 30 having an axis which extends through the door 16. One end of the rotatable shaft 30 is coupled to a handle 24, such that rotation of the handle causes the shaft to rotate about its axis. The opposite end of the shaft 30 is coupled to a pivotable plate 32. As the shaft is rotated by the rotation of the handle, the pivotal plate rotates between a first position (the solid line position) and a second position (the broken line position) shown in FIG. 2.

When in the solid line position, the plate 32 partially overlaps a portion of the rear wall 23 of the shell 22. As a result, the door 16 is inhibited from swinging outward to an open position. When both latches 28 are operated such that the plate 32 of each latch is in the solid line position (the latched position), the door 16 is securely held in a closed position. On the other hand, when both latches 28 are operated such that the plate 32 of each latch is in the broken line position (unlatched position), the door 16 may be readily swung opened by a person inside or outside of the shell 12.

As discussed above, some handle and latch mechanisms are provided with a key operated lock having a key receptacle (not shown) on the handle 24, to allow a person outside of the shell 12 to selectively lock or unlock the door 16 in a closed and latched position. However, shell door latching devices are typically provided with no mechanism to allow a person inside the shell to selectively lock or unlock the door 16 in a closed and latched position.

Therefore, it is an object of a preferred embodiment of the present invention to provide an apparatus and method by which a person located inside of the shell 12 may selectively lock or unlock the door 16 in a closed and latched position. It is a further object of a preferred embodiment of the present invention to provide such an apparatus and method which is operable with a typical latch mechanism 28, without requiring modification to the latch mechanism. It is yet a further object of a preferred embodiment of the present invention to provide a combination latch mechanism and locking device a person located inside of the shell 12 may selectively lock or unlock the door 16 in a closed and latched position.

Figure 3:
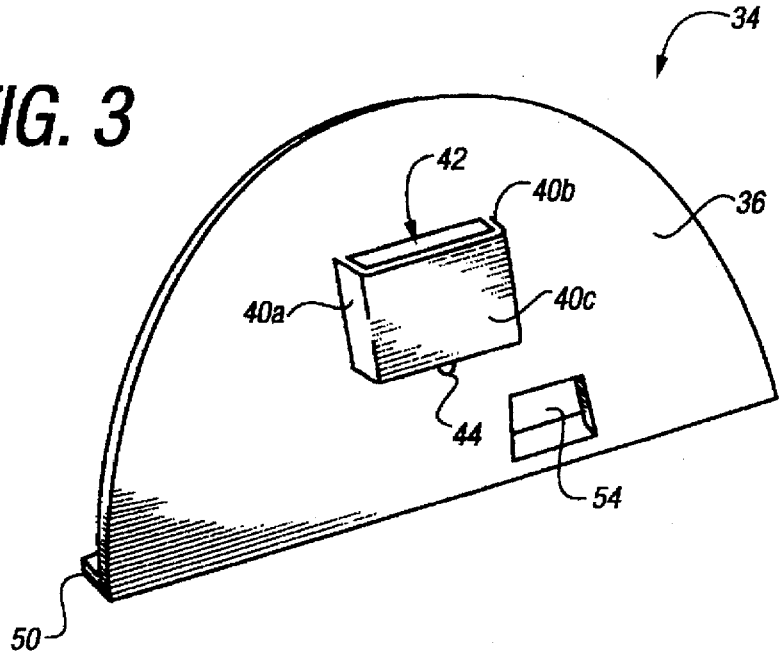
FIG. 3 is a rear perspective view of a shell door latch locking mechanism according to a preferred embodiment of the invention.
Figure 4:
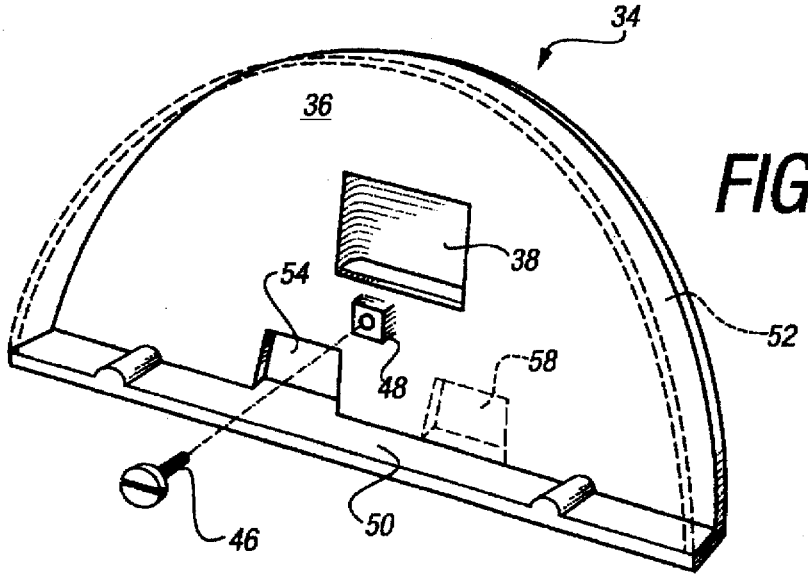
FIG. 4 is a front perspective view of the shell door latch locking mechanism of FIG. 3.
Figure 5:
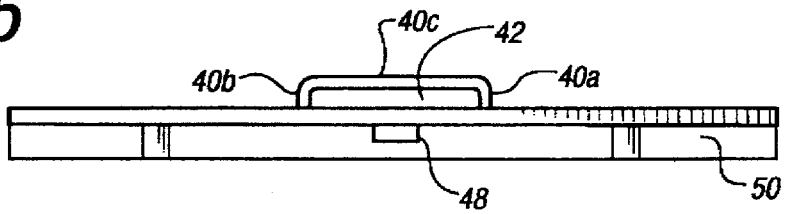
FIG. 5 is a top view of the shell door latch locking mechanism of FIG. 3.
Figure 7:
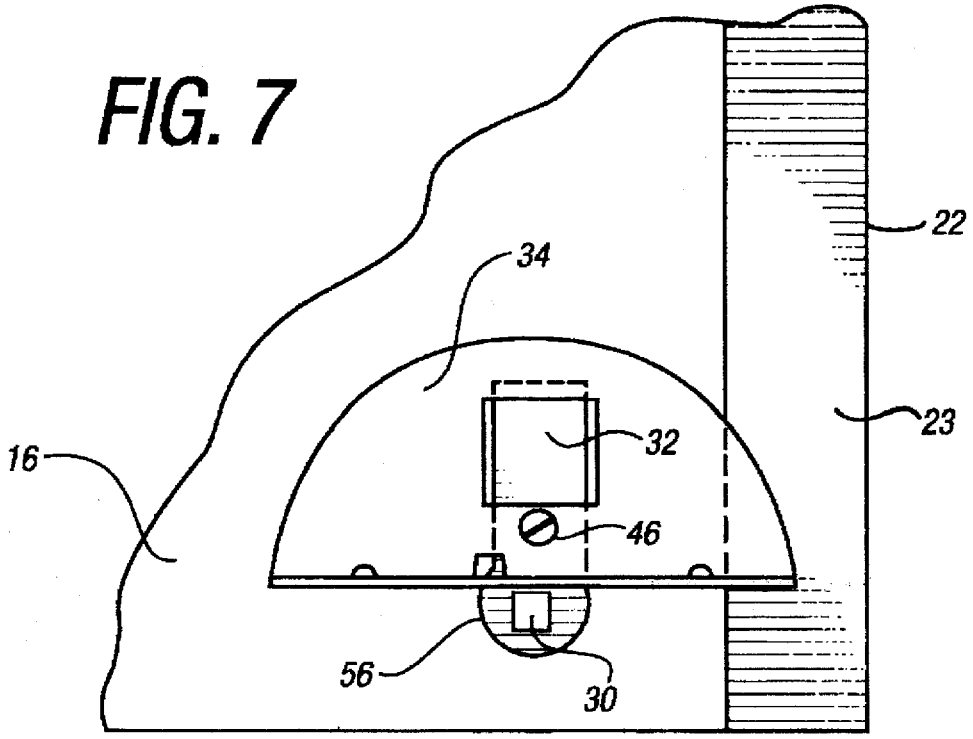
FIG. 7 shows the shell door latch mechanism of FIG. 2 in an unlatched position, with the shell door latch locking mechanism of FIG. 3 secured thereto.

A locking apparatus according to a preferred embodiment of the present invention is shown in FIGS. 3–5. FIGS. 3–5 show rear, front and top sides, respectively, of a rigid, unitary body 34 having a generally semicircular shape. Preferably, the generally semicircular body 34 is made out of plastic, metal or other suitable material having a suitable strength to withstand the force that might be exerted by a person attempting to open a shell door 16 when the body 34 is engaged with the latching mechanism as shown in FIG. 7.

The body 34 may be formed as a single unitary structure, as shown in FIGS. 3–5, by injection molding, other molding processes or other suitable manufacturing techniques. Alternatively, the body 34 may be formed of multiple pieces formed by molding, stamping or other suitable manufacturing techniques and coupled together to form the body configuration shown in the drawings.

Figure 6:
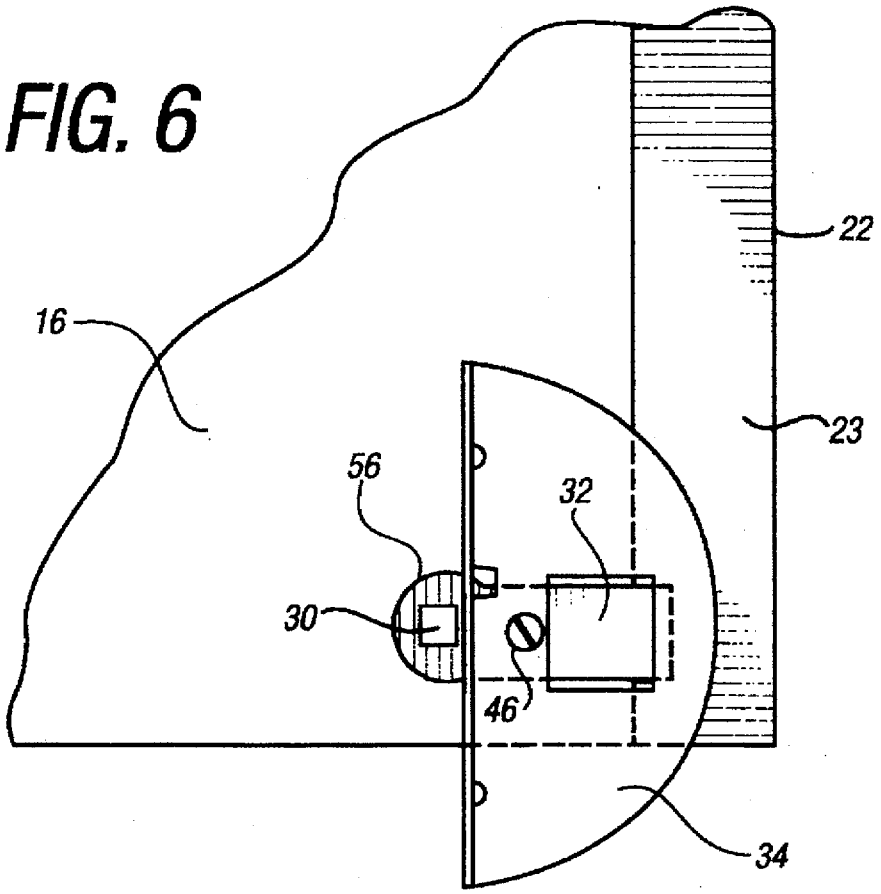
FIG. 6 shows the shell door latch mechanism of FIG. 2 in a latched position, with the shell door latch locking mechanism of FIG. 3 secured thereto.

The generally semicircular body 34 is composed of a semicircular plate 36 with a means for coupling the body 34 to the pivotable plate 32 of a latch mechanism. In the illustrated embodiment, the coupling means comprises a central portion 38 which is indented from the plate surface facing out of the page in FIG. 4 and protruding from the plate surface facing out of the page in FIG. 3. The central portion 38 defines a pair of sides **40*a* and 40*b* and a back 40*c* which form a slot or receptacle 42 for receiving the plate 32 of a latch mechanism to, thereby secure the body 34 to the pivotable plate 32, as shown in FIGS. 6 and 7**.

Preferably, the coupling means on the plate 36 also includes an aperture 44, defining a threaded channel through the plate, for receiving a threaded set screw 46. Preferably, the set screw has a head configured to be readily gripped between the user's thumb and index finger for rotation. A portion of the plate 36 may be widened (e.g., as shown at 48 in FIGS. 4 and 5) to provide a deeper threaded channel in which the set screw may pass.

The receptacle 42, formed by the central portion 38 of the plate, and the set screw aperture 44 are preferred embodiments of a coupling means, because they can be formed as a single piece structure and/or by relatively simple manufacturing techniques, including molding techniques. However, further embodiments include other mechanisms for securing the body 34 to the pivotable plate 32, such as a loop formed of rigid material and/or wire for encircling the plate 32, a clamp or the like.

A lip 50 may be provided along the straight edge of plate 36 (and/or a lip 52, shown in broken lines in FIG. 4, may be provided along the curved edge of the plate 36) to increase the structural strength and rigidity of the body 34. The lips 50 and/or 52 allow the plate 36 to be formed relatively thin, yet provide the body 34 with the strength and rigidity necessary for proper operation. However, in further embodiments, the lip 50 (and lip 52) may be omitted, provided the plate is formed of a suitable material and thickness to provide the necessary strength and rigidity.

In preferred embodiments, the plate 36 is provided with a notch or opening 54 positioned laterally offset to one side of the central portion 38, to correspond with a widened portion 56 typically present on conventional latch plates 32 as shown in FIGS. 6 and 7. A second notch or opening (shown in broken lines at 58 in FIG. 4) may be laterally offset to the opposite side of the central portion 38, such that the body 34 could cooperate with a latch plate 32 having either a left facing or right facing widened portion, or both.

In operation, a person inside of a shell 12 may place a generally semicircular body 34 on one or more latch mechanisms 28, by inserting the free end of the pivotable plate 32 of each latch mechanism through the slot or receptacle 42 of a respective body 34. The receptacle 42 of each body 34 functions to secure each body to a respective plate 32. The optional set screws 46 may be tightened to further secure each body 34 to a respective plate 32.

In this manner, a generally semicircular body 34 is slid onto each plate 32, in the manner shown in FIGS. 6 and 7. When so positioned, the door 16 will be locked in a closed position, independent of the position of the pivotable plate 32.

For example, when the pivotable plate 32 is rotated to the locked position, as shown in the solid line in FIG. 2 and as shown in FIG. 6, a portion of the plate 32 overlaps the rear wall 23 of the shell and inhibits the door from being swung open, as discussed above. However, when the pivotable plate 32 is rotated to the normally unlocked position, as shown in FIG. 7, a portion of the body 34 overlaps the rear wall 23, inhibiting the door from being swung open and, thus maintain the door locked in a closed position. Moreover, the generally semicircular shape of the body 34 ensures that a portion of the body is overlapping the rear wall 34 at all times during the rotation of the plate 32 from the position shown in FIG. 6 to the position shown in FIG. 7. In addition, the generally semicircular shape of the body 34 allows the same body to be placed either on the left or right latch mechanism, simplifying the operation of the apparatus.

With the bodies 34 secured to the hatch mechanism plates 32, a person outside of the shell 12 could manipulate the handles 24 between the latched and unlatched positions. However, because either the latch plate 32 or the generally semicircular plate 36 is overlapping the rear wall 23 at all times, the person outside of the shell would not be able to unlock the door 16. Accordingly, a person inside of the shell 12 would have an added degree of security.

While the above description refers to particular embodiments of the present invention, it will be understood that many modifications may be made without departing from the spirit thereof. For example, while preferred embodiments employ a generally semicircular body 34, it will be understood that bodies having other shapes would function similarly as described above, provided that the shapes result in at least a portion of the bodies overlapping a portion of the shell 12 and/or the tailgate 18 or truck bed 14 upon the plate 32 being in the unlatched position. For example, FIGS. 8 and 9 illustrate an example of a locking device 60 having a portion (extensions 62 and 64) which overlaps the tailgate 18 of the truck bed upon the late 32 being in the unlatched position, as shown in FIG. 8. The overlapping extensions 62 and 64 inhibit the door 16 from being opened from the outside of the shell and, thus, effectively locks the shell do from the inside. According to the embodiment of FIGS. 8 and 9, coupling means, composed of a receptacle 66 for receiving the plate 32, is provided for selectively coupling the device 60 to the late 32. A set screw 68 may be provided for further securement. Furthermore, embodiments are described above with reference to a conventional shell latch mechanism mounted on the door of a shell and having a pivotal plate which is selectably moveable to engage or overlap a portion of the shell, pick-up truck bed or tailgate, to latch the shell door in a closed position. However, it will be understood that embodiments of the invention would also be operable (in a similar manner as described above) for a shell door latch mechanism that is mounted on the shell, pick-up truck or tailgate and which includes a pivotal plate adapted to be selectably movable to engage a portion of the shell door to latch the shell door in a closed position. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A locking device for a pick-up truck shell of the type having a shell body defining a shell interior and a shell door hinged to the shell body for movement relative to the shell body between a closed position and an open position, and at least one latch mechanism coupled to the shell door and having a pivotal plate moveable between a first position and a second position, wherein the pivotal plate overlaps a portion of the shell body upon the pivotal plate being in the first position and the shell door being in a closed position, and wherein the pivotal plate does not overlap a portion of the shell body Upon the pivotal plate being in the second position, the locking device comprising:

a substantially rigid body;

securing means for selectively securing and the substantially rigid body to the pivotal plate and selectively detaching the substantially rigid body from the pivotal plate from inside of the shell interior;

wherein the substantially rigid body has a body portion which overlaps a portion of the shell body upon the substantially rigid body being secured to the pivotal plate while the shell door is in the closed position and while the pivotal plate is in the second position; and wherein the substantially rigid body comprises a generally semicircular shaped plate having a generally straight edge and a lip extending along the generally straight edge for increasing the rigidity of the body.

2. A locking device for a pick-up truck shell of the type having a shell body defining a shell interior and a shell door hinged to the shell body for movement relative to the shell body between a closed position and an open position, and at least one latch mechanism coupled to the shell door and having a pivotal plate moveable between a first position and a second position, wherein the pivotal plate overlaps a portion of the shell body upon the pivotal plate being in the first position and the shell door being in a closed position, and wherein the pivotal plate does not overlap a portion of the shell body upon the pivotal plate being in the second position, the locking device comprising:

a substantially rigid body;

securing means for selectively securing and the substantially rigid body to the pivotal plate and selectively detaching the substantially rigid body from the pivotal plate from inside of the shell interior:

wherein the substantially rigid body has a body portion which overlaps a portion of the shell body upon the substantially rigid body being secured to the pivotal plate while the shell door is in the closed position and while the pivotal plate is in the second position; and wherein the substantially rigid body comprises a generally semicircular shaped plate having a curved edge and a lip extending along the curved edge for increasing the rigidity of the body.

3. A locking device for a pick-up truck shell of the type having a shell body defining a shell interior and a shell door hinged to the shell body for movement relative to the shell body between a closed position and an open position, and at least one latch mechanism coupled to the shell door and having a pivotal plate moveable between a first position and a second position, wherein the pivotal plate overlaps a portion of the shell body upon the pivotal plate being in the first position and the shell door being in a closed position, and wherein the pivotal plate does not overlap a portion of the shell body upon the pivotal plate being in the second position, the locking device comprising:

a substantially rigid body:

securing means for selectively securing and the substantially rigid body to the pivotal plate and selectively detaching the substantially rigid body from the pivotal plate from inside of the shell interior;

wherein the substantially rigid body has a body portion which overlaps a portion of the shell body upon the substantially rigid body being secured to the pivotal plate while the shell door is in the closed position and while the pivotal plate is in the second position; and wherein the substantially rigid body comprises a generally semicircular shaped plate having a generally straight edge and a curved edge and a lip extending along the generally straight edge and the generally curved edge for increasing the rigidity of the body.

4. A method of latching and locking the door of a pick-up truck shell body having a latching mechanism mounted to the door and provided with a pivotal plate moveable between a first position and a second position, wherein the pivotal plate overlaps a portion of the shell body upon the pivotal plate being in the first position and the shell door being in a closed position, and wherein the pivotal plate does not overlap a portion of the shell body upon the pivotal plate being in the second position, the method comprising the steps of:

disposing the door in the closed position;

securing a substantially rigid body to the pivotal plate from inside of the shell body; and overlapping a portion of the shell body with a portion of the substantially rigid body upon the substantially rigid body being secured to the pivotal plate while the shell door is in the closed position and while the pivotal plate is in the second position.

5. A locking device in combination with a pick-up truck shell, the combination comprising:

a shell body defining a shell interior;

a shell door hinged to the shell body for movement relative to the shell body between a closed position and an open position;

at least one latch mechanism coupled to the shell door and having a pivotal plate moveable between a first position and a second position, wherein the pivotal plate overlaps a portion of the shell body upon the pivotal plate being in the first position and the shell door being in a closed position, and wherein the pivotal plate does not overlap a portion of the shell body upon the pivotal plate being in the second position;

a substantially rigid body;

securing means for selectively securing the substantially rigid body to the pivotal plate and selectively detaching the substantially rigid body from the pivotal plate from inside of the shell interior;

wherein the substantially rigid body has a body portion which overlaps a portion of the shell body upon the substantially rigid body being secured to the pivotal plate while the shell door is in the closed position and while the pivotal plate is in the second position.

* * * * *